US010329705B2

(12) United States Patent
Leibman et al.

(10) Patent No.: US 10,329,705 B2
(45) Date of Patent: Jun. 25, 2019

(54) WASHING MACHINE AND FLUID ADDITIVE RECEPTACLE

(71) Applicant: Haier US Appliance Solutions, Inc., Wilmington, DE (US)

(72) Inventors: Alexander B. Leibman, Prospect, KY (US); Manidhar V V S Yandamuri, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 163 days.

(21) Appl. No.: 15/398,758

(22) Filed: Jan. 5, 2017

(65) Prior Publication Data

US 2018/0187360 A1 Jul. 5, 2018

(51) Int. Cl.

| | |
|---|---|
| ***D06F 23/04*** | (2006.01) |
| ***D06F 37/12*** | (2006.01) |
| ***D06F 39/02*** | (2006.01) |
| ***D06F 39/14*** | (2006.01) |
| ***D06F 39/12*** | (2006.01) |

(52) U.S. Cl.
CPC ..... *D06F 39/022* (2013.01); *D06F 37/12* (2013.01); *D06F 23/04* (2013.01); *D06F 39/12* (2013.01); *D06F 39/14* (2013.01)

(58) Field of Classification Search
CPC ..... D06F 39/02; D06F 39/022
See application file for complete search history.

(56) References Cited

U.S. PATENT DOCUMENTS

| | | | | |
|---|---|---|---|---|
| 7,257,969 | B2 | 8/2007 | Kim et al. | |
| 2005/0097925 | A1* | 5/2005 | Kim | D06F 39/02 68/12.18 |
| 2016/0186370 | A1 | 6/2016 | Kim et al. | |

FOREIGN PATENT DOCUMENTS

| | | | |
|---|---|---|---|
| JP | 04258257 | B2 | 4/2009 |

* cited by examiner

*Primary Examiner* — Spencer E Bell
(74) *Attorney, Agent, or Firm* — Dority & Manning, P.A.

(57) ABSTRACT

A washing machine, including a fluid additive receptacle, is generally provided herein. The fluid additive receptacle may include a receptacle body, a door, and a pin. The receptacle body may define a body opening to receive an additive therethrough. The receptacle body may further define a mounting channel. The door may be removably mated to the receptacle body to selectively cover the body opening. The pin may extend along a pin axis from the door to the receptacle body. The pin may be slidably positioned within the mounting channel and pivotable about the pin axis.

18 Claims, 10 Drawing Sheets

WASHING MACHINE AND FLUID ADDITIVE RECEPTACLE

FIELD OF THE INVENTION

The present subject matter relates generally to washing machine appliances, and more particularly to washing machine appliances having a fluid additive receptacle.

BACKGROUND OF THE INVENTION

Washing machine appliances generally include a tub with a drum rotatably mounted therein. The drum defines a wash chamber for receipt of articles for washing. During operation of such washing machine appliances, a wash liquid is directed into the tub and onto articles within the wash chamber of the drum. The drum can rotate at various speeds to agitate articles within the wash chamber in the wash fluid, wring wash fluid from articles within the wash chamber, etc.

During operation of certain washing machine appliances, a volume of wash liquid is directed into the tub in order to wash and/or rinse articles within the wash chamber of the drum. One or more fluid additives may be added to the wash liquid to enhance the cleaning or other properties of the wash liquid. For example, bleach may be added to the wash liquid to enhance whitening and/or sterilizing of articles within the drum.

In order to introduce fluid additive into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a tray or container mounted to a top panel of a vertical axis washing machine appliance can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance.

However, in both vertical and horizontal axis washing machine appliances, a separate tray or container may be provided for each particular fluid additive. Thus, for example, a washing machine appliance can require a container for a detergent and a container for bleach. A door may be provided to distinguish and/or cover one tray or container during certain conditions. However, certain design constraints can limit this approach.

In particular, the washing machine appliance's wash basket is typically rotatably mounted within the wash tub. Thus, the wash basket spins within the wash tub during operation of the appliance. The door may become misaligned or fall off as the wash basket spins and/or the washing machine is installed out of level. It is possible that one or more additives may spill or enter the wrong tray.

Accordingly, a washing machine appliance with features for improved handling of fluid additives would be useful. Also, a washing machine appliance with features for covering an additive receptacle and hindering spilling of fluid additives would be useful. In particular, a washing machine appliance with features for more reliably aligning and covering the opening of an additive receptacle would be useful.

BRIEF DESCRIPTION OF THE INVENTION

Aspects and advantages of the invention will be set forth in part in the following description, or may be obvious from the description, or may be learned through practice of the invention.

In one aspect of the present disclosure, a fluid additive receptacle for a washing machine appliance provided. The fluid additive receptacle may include a receptacle body, a door, and a pin. The receptacle body may define a body opening to receive an additive therethrough. The receptacle body may further define a mounting channel. The door may be removably mated to the receptacle body to selectively cover the body opening. The pin may extend along a pin axis from the door to the receptacle body. The pin may be slidably positioned within the mounting channel and pivotable about the pin axis.

In another aspect of the present disclosure, a washing machine appliance may be provided. The washing machine appliance may include a cabinet, a tub, a basket, and a fluid additive receptacle. The cabinet may include a top cover that defines an opening. The tub may be disposed within the cabinet below the top cover. The basket may be rotatably mounted within the tub. The fluid additive receptacle may include a receptacle body, a door, and a magnetic alignment pair. The receptacle body may define a body opening to receive an additive therethrough. The receptacle body including a sloped perimeter extending about the body opening and being directed thereto. The door may include a contoured edge that is matched to the sloped perimeter of the receptacle body. The door may be removably mated to the receptacle body at the contoured edge to selectively cover the body opening. The magnetic alignment pair may bias the door toward the receptacle body. The magnetic alignment pair may further include a first magnetic element and a second magnetic element.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
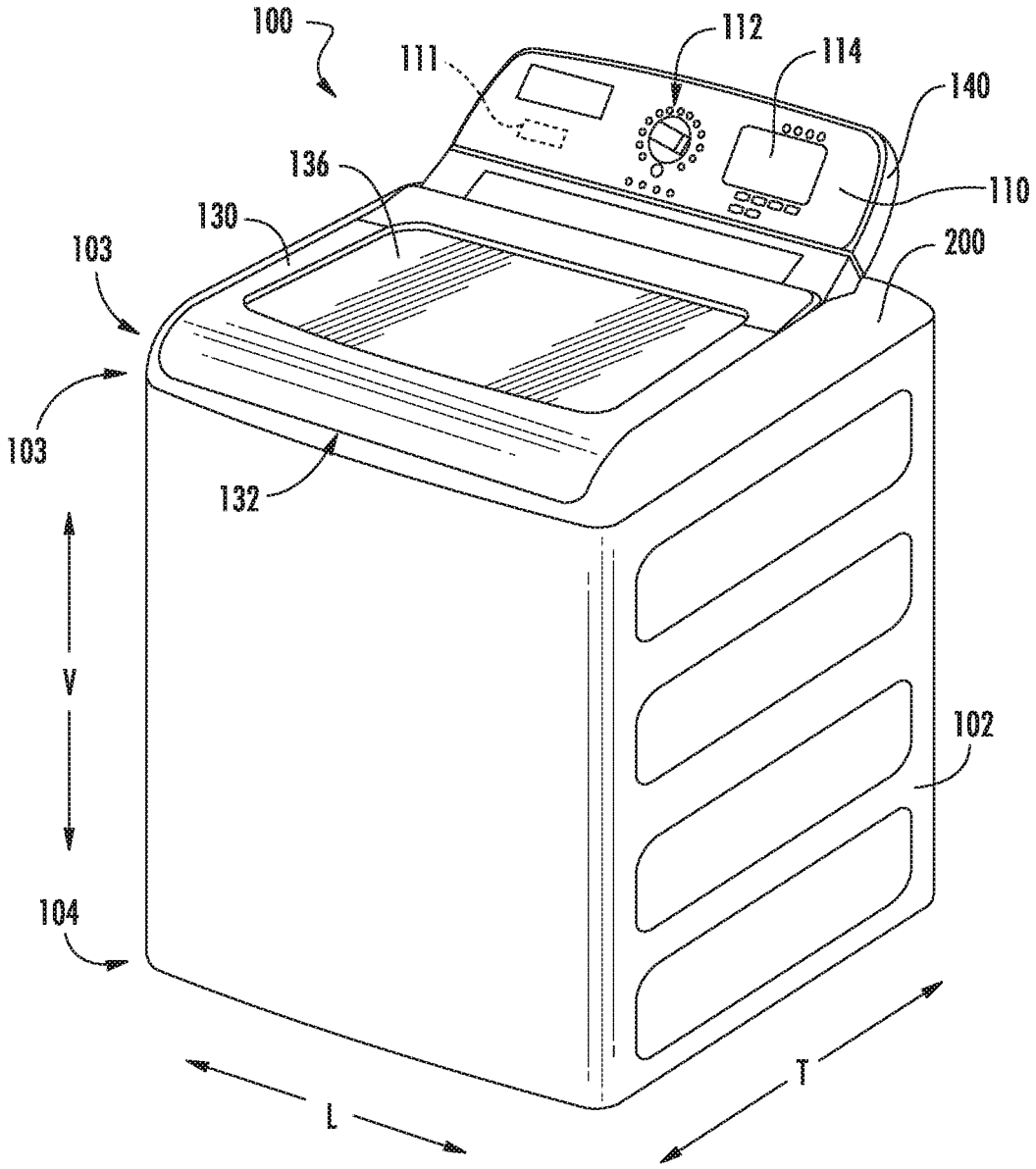
FIG. 1 provides a perspective view of a washing machine appliance according to example embodiments of the present disclosure, wherein the door of the example washing machine appliance is shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, the present disclosure may include a washing machine appliance that has a fluid additive receptacle for receiving fluid additives. The fluid additive receptacle may have a door that can cover an opening in the fluid additive receptacle. Specifically, the door may substantially cover and block the opening in a covered position. The door may be configured so that it can slide vertically and rotate about a single axis. One or more features may be included that automatically align the door to the opening when the door is in the covered position.

Figure 2:
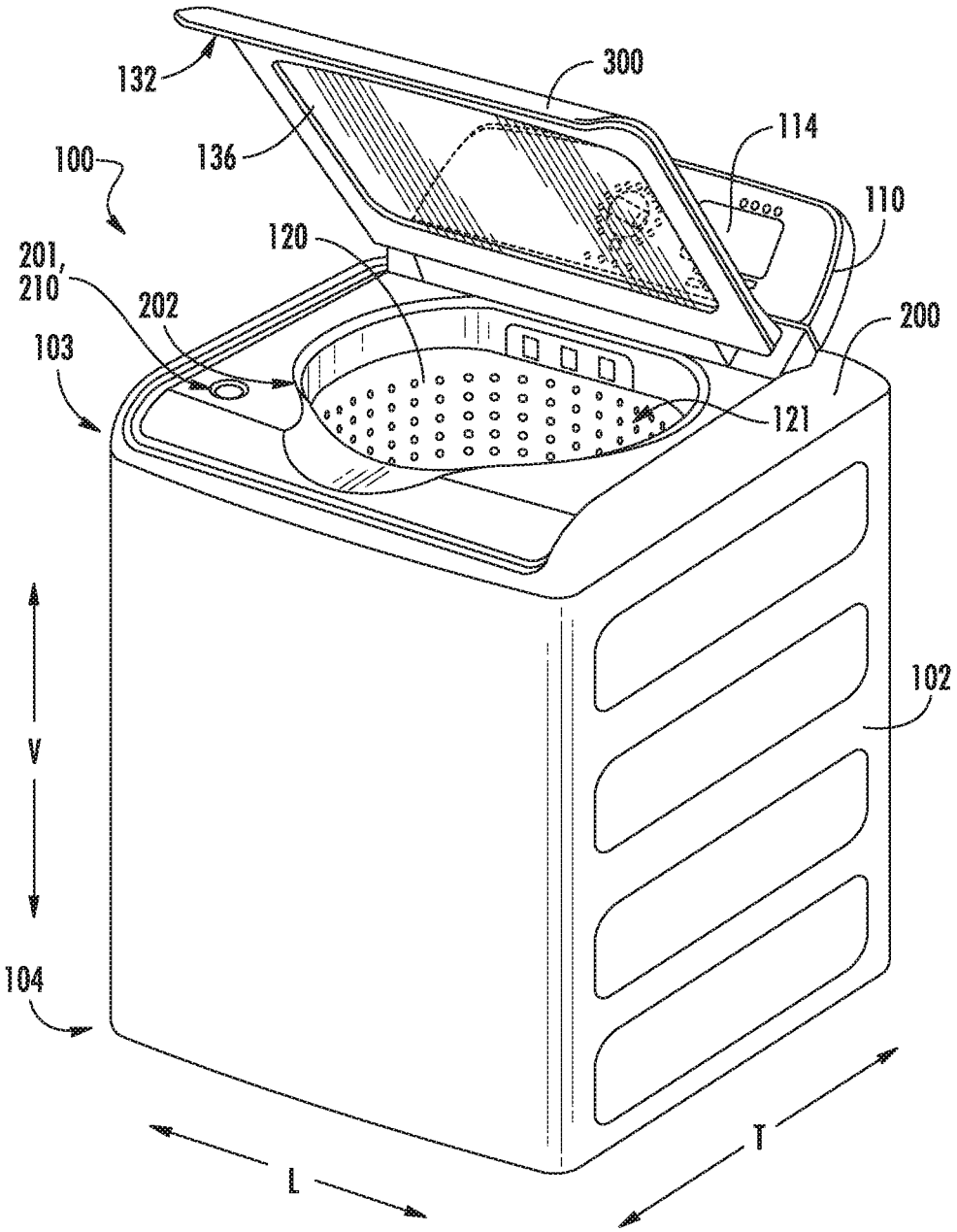
FIG. 2 provides a perspective view of the example washing machine appliance of FIG. 1, wherein the door of the example washing machine appliance is shown in an open position.

FIGS. 1 and 2 illustrate an example embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top portion 103 and a bottom portion 104 along a vertical direction V. Cabinet 102 generally defines a vertical direction V, a lateral direction L, and a transverse direction T. The vertical direction V, lateral direction L, and transverse direction T are all mutually perpendicular and form an orthogonal direction system.

A wash basket 120 is rotatably mounted within cabinet 102, e.g., within a tub 118 positioned within cabinet 102. A motor (not shown) is in mechanical communication with wash basket 120 in order to selectively rotate wash basket 120 within tub 118, e.g., during an agitation or a rinse cycle of washing machine appliance 100. Wash basket 120 defines a wash chamber 121 that is configured for receipt of articles for washing. An agitator or impeller (not shown) extends from wash basket 120 into wash chamber 121. The impeller assists agitation of articles disposed within wash chamber 121 during operation of washing machine appliance 100, as will be understood by those skilled in the art.

Cabinet 102 of washing machine appliance 100 has a top cover or panel 200, e.g., at or adjacent top portion 103 of cabinet 102. Top cover 200 defines an aperture 202 that permits user access to wash chamber 121 of wash basket 120. Door 130 is rotatably mounted to top cover 200. However, alternatively, door 130 may be mounted to cabinet 102 or any outer suitable support. When assembled, door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Figure 3:
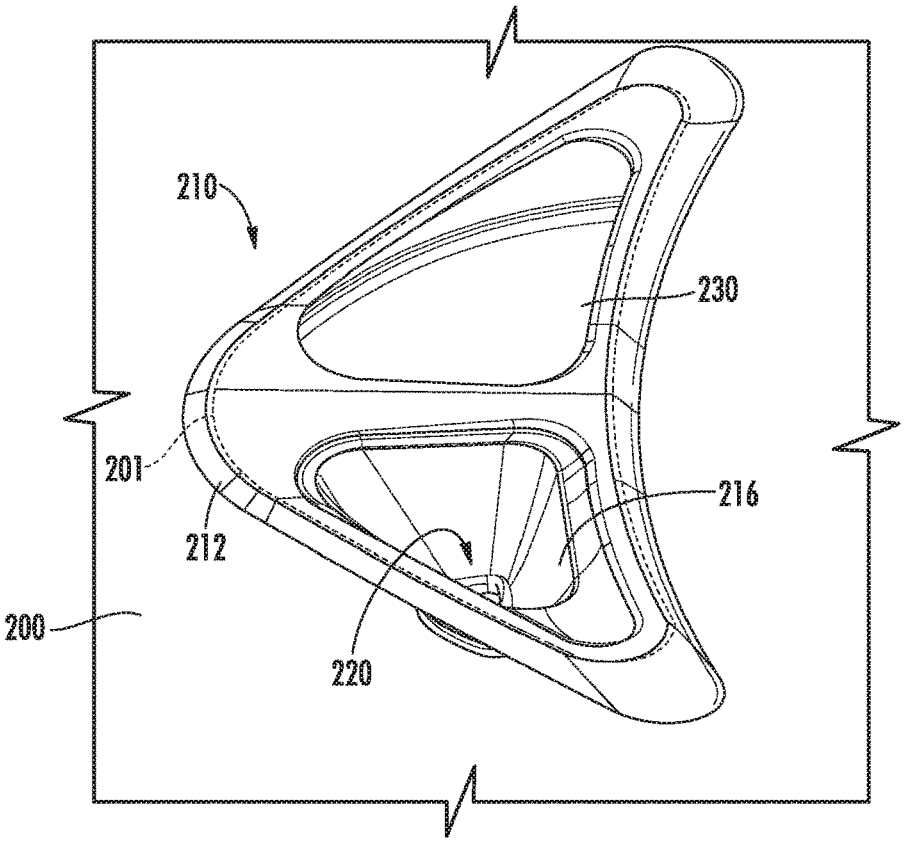
FIG. 3 provides a perspective view of a fluid additive receptacle according to example embodiments of the present disclosure, wherein the door is in a covered position.
Figure 4:
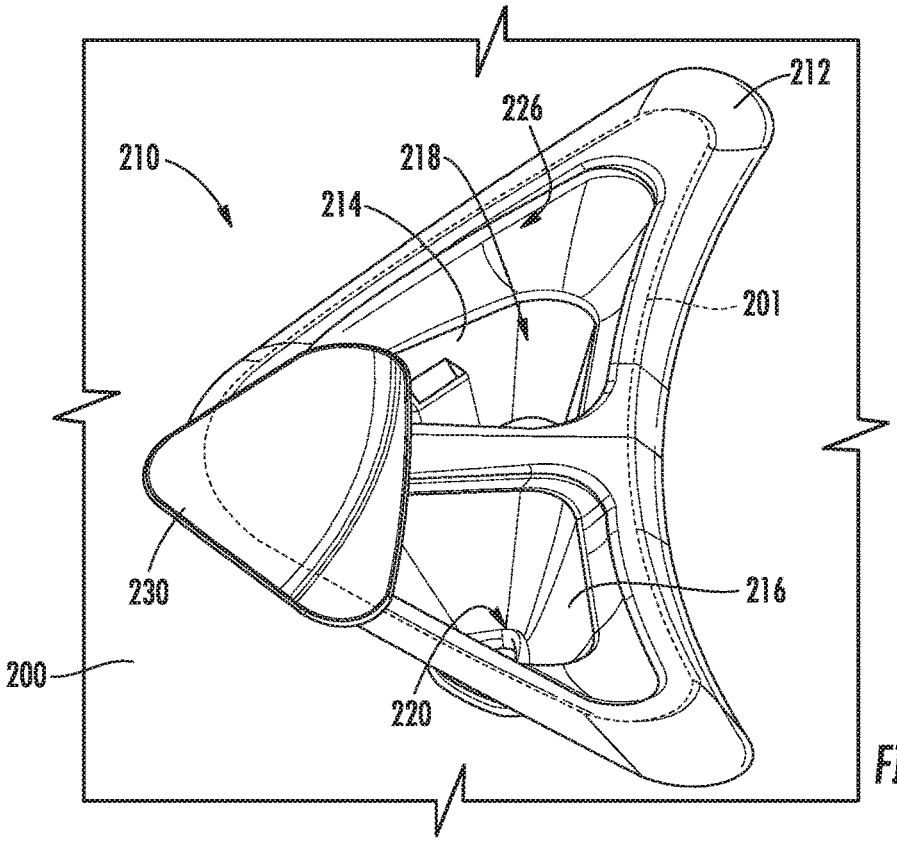
FIG. 4 provides a perspective view of the example fluid additive receptacle of FIG. 3, wherein the door is in an uncovered position.
Figure 5:
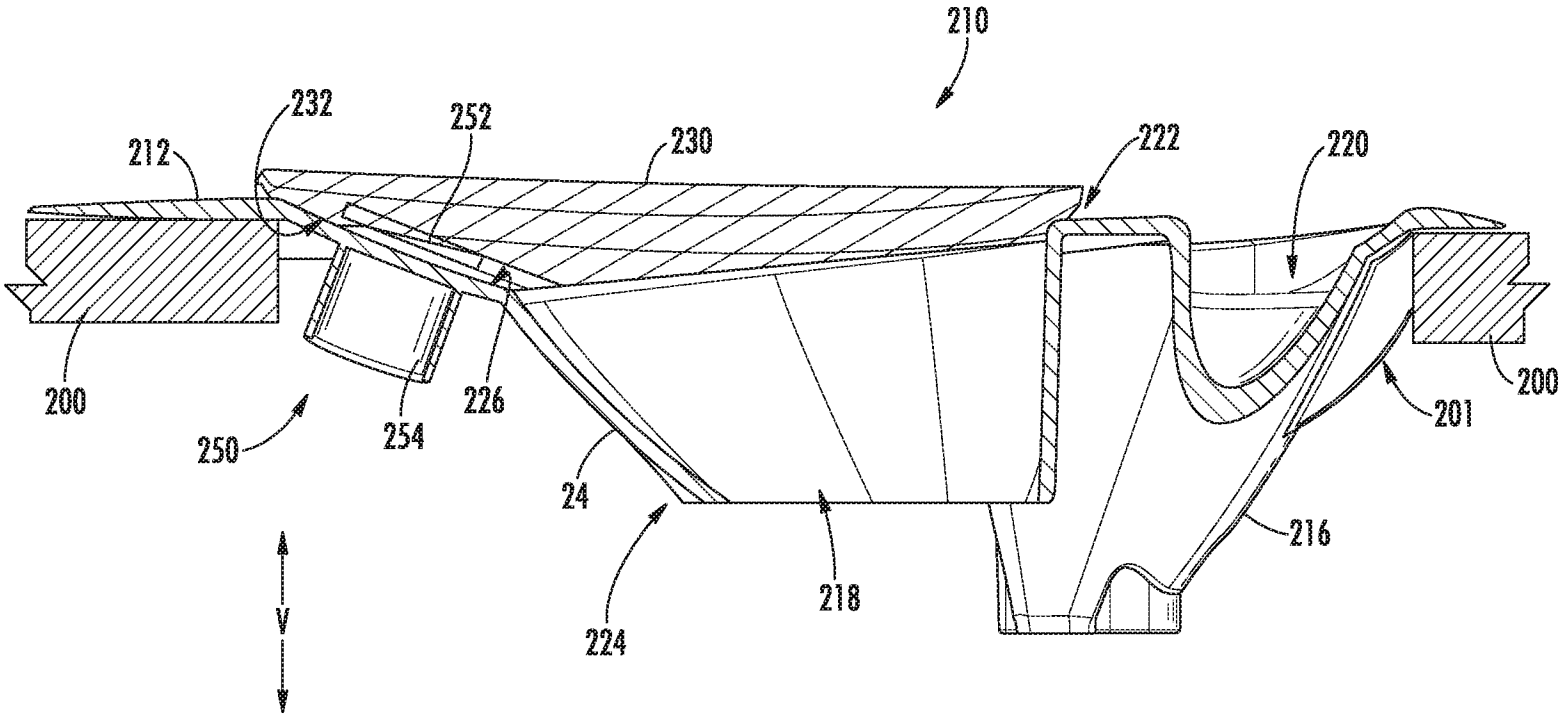
FIG. 5 provides a cross-sectional side view of the example fluid additive receptacle of FIG. 3.
Figure 6:
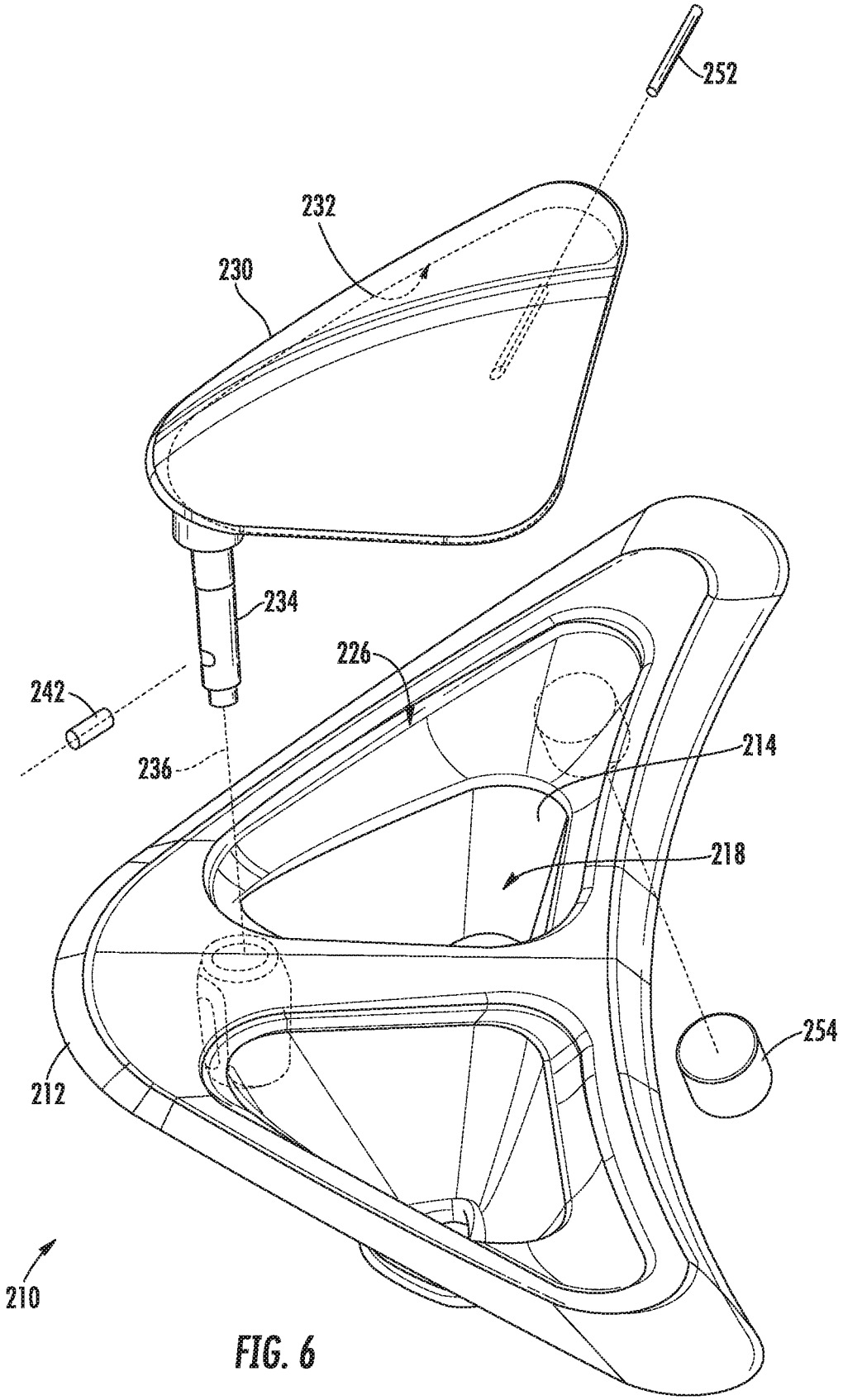
FIG. 6 provides an exploded perspective view of the example fluid additive receptacle of FIG. 3.
Figure 7:
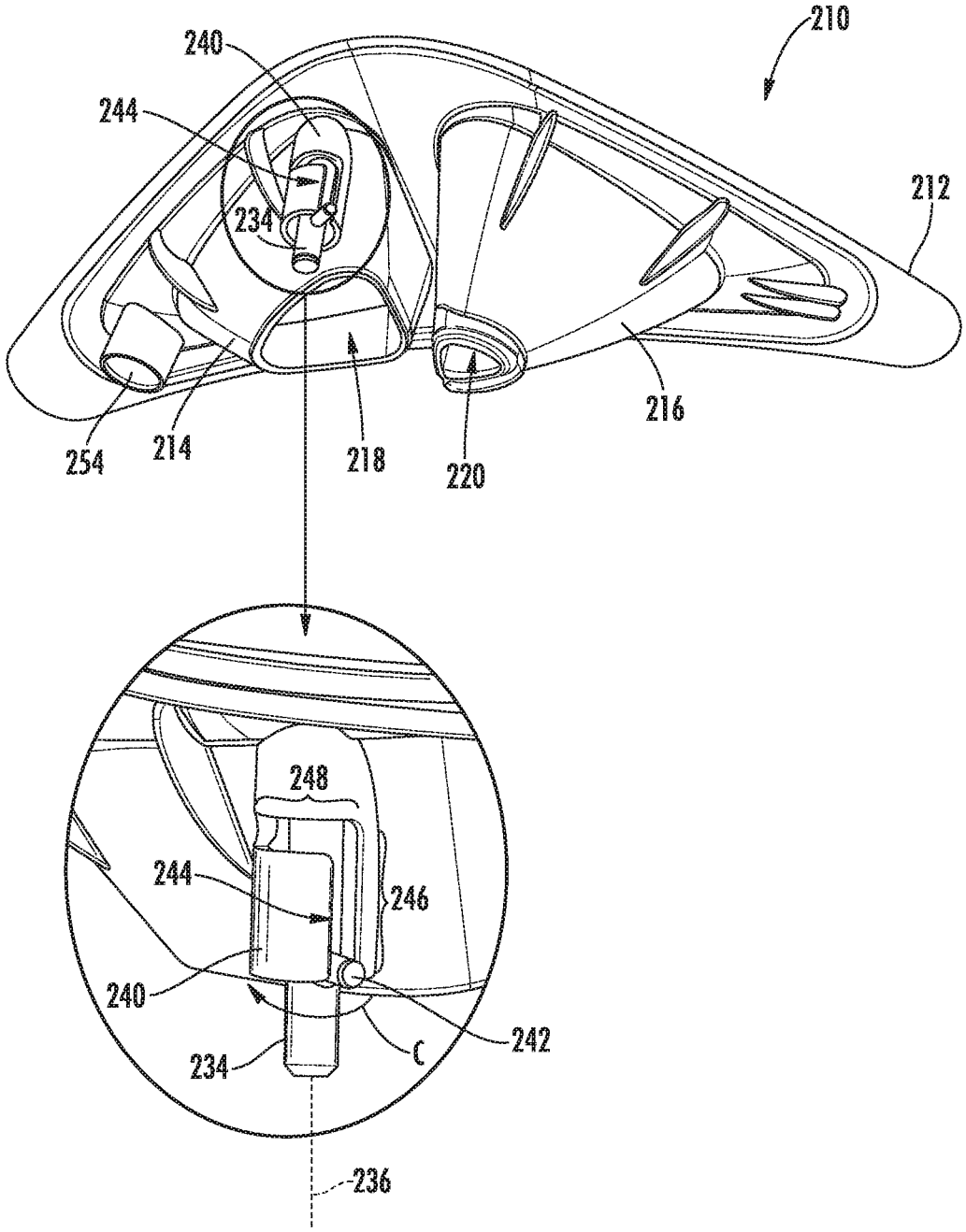
FIG. 7 provides a bottom perspective view of the example fluid additive receptacle of FIG. 3, including a magnified portion of a pin and sleeve.

Top cover 200 defines a hole or opening 201, e.g., at a corner of top cover 200 at or adjacent to a front portion of top cover 200. Opening 201 is configured for receipt of one of a plurality of fluid additives, such as detergent, fabric softener or bleach. Opening 201 permits the fluid additive to pass through top cover 200, e.g., through portions of a fluid additive receptacle 210 (see FIG. 3) extending below top cover 200 along the vertical direction V. Thus, a user may pour the fluid additives through fluid additive receptacle 210 and opening 201 in top cover 200. In certain example embodiments, fluid additive receptacle 210 may be configured as a detergent and/or bleach receptacle. Fluid additive receptacle 210 is described in greater detail below.

A control panel 110 with a plurality of input selectors 112 extends from top cover 200. Control panel 110 and input selectors 112 collectively form a user input interface for operator selection of machine cycles and features. A display 114 of control panel 130 indicates selected features, a countdown timer, and/or other items of interest to appliance users.

Operation of washing machine appliance 100 is controlled by a controller or processing device 108 that is operatively coupled to control panel 110 for user manipulation to select washing machine cycles and features. In response to user manipulation of control panel 110, the controller 108 operates the various components of washing machine appliance 100 to execute selected machine cycles and features.

In an illustrative embodiment, laundry items are loaded into wash chamber 121 through aperture 202, and washing operation is initiated through operator manipulation of input selectors 112. Wash basket 120 and/or tub 118 within cabinet 102 is filled with water and detergent to form a wash fluid. One or more valves (not shown) can be controlled by washing machine appliance 100 to provide for filling wash basket 120 to the appropriate level for the amount of articles being washed. Once wash basket 120 is properly filled with fluid, the contents of wash chamber 121 are agitated, e.g., with the impeller within wash basket 120, for cleansing of laundry items in wash basket 120.

After the agitation phase of the wash cycle is completed, wash basket 120 is drained. Laundry articles can then be rinsed by again adding fluid to wash basket 120, depending on the particulars of the cleaning cycle selected by a user, the impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through aperture 202.

As discussed above, wash basket 120 is rotatably mounted within tub 118 in cabinet 102. Wash basket 120 may be spaced apart from tub 118, e.g., by a radial gap, in order to permit rotation of wash basket 120 within tub 118. Tub 118 is configured for containing wash and rinse fluids during operation of washing machine appliance 100 described above. Wash and rinse fluids disposed within tub 118 can be used to clean articles disposed in wash basket 120. Wash and rinse fluids can pass between wash basket 120 and tub 118 through a plurality of perforations defined by wash basket 120, e.g., during the wash and/or spin cycles described above.

As discussed above, fluid additive receptacle 210 is mounted above tub 118 and wash basket 120, e.g., along the vertical direction V. More particularly, fluid additive receptacle 210 may be mounted above the radial gap between tub 118 and wash basket 120. Fluid additive receptacle 210 is configured for receipt of fluid additive, e.g., through opening 201. Fluid additive receptacle 210 may also be configured for directing the fluid additive into the radial gap between tub 118 and wash basket 120. For example, fluid additive receptacle 210 may direct fluid additive into the radial gap between tub 118 and wash basket 120 prior to or during a wash cycle of washing machine appliance 100. Similarly, fluid additive receptacle 210 may direct fluid additive into the radial gap between tub 118 and wash basket 120 prior to or during a rinse cycle of washing machine appliance 100. Alternatively, a separate conduit or passage may be provided for directing fluid additive from fluid additive receptacle 210 to wash basket 120.

FIGS. 3 through 7 provide multiple views of an example fluid additive receptacle 210. Generally, fluid additive receptacle 210 includes a receptacle body 212, e.g., mounted, above wash basket 120 (FIG. 2) and a wash tub 119 (FIG. 2) of washing machine appliance 100 (FIG. 2). Washing machine appliance 100 may include gap and/or container (not pictured) to receive additive directed through fluid additive receptacle 210.

As shown, receptacle body 212 includes a funnel or cup 214 defining a body opening 218 to receive an additive therethrough. Cup 214 extends from a top portion 222 to a bottom portion 224, e.g., along the vertical direction V. At cup 214, and specifically above the bottom portion 224 of cup 214, receptacle body 212 includes a sloped perimeter 226 extending about body opening 218. Sloped perimeter 226 may be generally directed toward body opening 218. In some embodiments, sloped perimeter 226 is formed along the top portion 222 of cup 214. As shown, sloped perimeter 226 may define a maximum (e.g., radially-outermost limit) of body opening 218.

Optional embodiments, such as those shown in FIGS. 3 through 7, include a plurality of cups 214, 216, each defining a separate opening 218, 220. For instance, receptacle body 212 may include a first cup 214 defining body opening 218, as well as second cup 216 defining a secondary opening 220. Second cup 216, including secondary opening 220, may be spaced apart from first cup 214, e.g., such that body opening 218 and secondary opening 220 form parallel paths that are fluidly isolated from each other. Each opening 218, 220 may be in fluid communication with a discrete gap or container to receive a separate additive. In certain embodiments, receptacle body 212, including first cup 214 and second cup 216, is formed as a single integral body (e.g., a monolithic unitary structure).

When assembled, receptacle body 212 is received within opening 201 of top cover 200. In particular, receptacle body 212 may be received within opening 201 of top cover 200 over one or more reservoir(s) (not pictured) such that receptacle body 212 hides reservoir(s) and reservoir(s) are not visible to a user of washing machine appliance 100 from above top cover 200. As an example, receptacle body 212 may be snap-fit or otherwise suitably mounted to top cover 200 at opening 201 of top cover 200.

A door 230 is generally provided on receptacle body 212. Door 230 may be removably mated to receptacle body 212 to selectively cover body opening 218. Specifically, door 230 may be movable between a covered position (see FIG. 3) and an uncovered positioned (see FIG. 4). As will be described in detail below, door 230 may rotate and/or slide vertically between the covered and uncovered positions. As shown, in the covered position, door 230 generally restricts or inhibits access to body opening 218. Conversely, in the uncovered position, door 230 generally permits access to body opening 218. Optionally, moving door 230 from the covered position to the uncovered position may require moving door 230 vertically separate from, or in conjunction with, rotation. When door 230 is moved out of the covered position, e.g., to the uncovered position, door 230 may extend vertically above top cover 200 (FIG. 2). Thus, when door 230 is not in the covered position, door 230 may interfere with the closed position of door 130. If door 230 is not properly aligned in the covered position, door 230 may prevent door 130 from moving to the closed position Door 230 is generally shaped to extend across all or some of body opening 218. In some embodiments, a contoured edge 232 of door 230 is matched to a corresponding portion of receptacle body 212. For instance, contoured edge 232 may be matched to the sloped perimeter 226 of receptacle body 212. When door 230 is in the covered position, contoured edge 232 may engage (e.g., directly contact) sloped perimeter 226. The matched edge-perimeter interface may advantageously align door 230 to receptacle body 212 in the closed position, e.g., as biased by gravity.

Door 230 may be formed as a solid, non-permeable member. Thus, door 230 may prevent fluid additive from passing through body opening 218 when in the closed position. Optionally, a window 233 (see FIG. 8) may form a portion of door 230, e.g., as a transparent panel of glass or poly(methyl methacrylate) (PMMA) that extends across all or some of door 230. In such embodiments, body opening 218 may be visible through window 233 when door 230 is in the covered position. Window 233 may be constructed in a manner such that it provides magnification of the body opening 218. More specifically, window 233 may operate in a manner similar to a magnifying glass. For example, window 233 may have a convex shape embedded within or as part of door 230.

In embodiments wherein receptacle body 212 includes multiple openings for additives, such as body opening 218 and secondary opening 220, a single door 230 may be provided. Door 230 may be positioned to only cover a single opening. In the illustrated embodiments, door 230 corresponds to first cup 214 and is configured to move between the covered position and the uncovered position exclusively in relation to body opening 218. Advantageously, a user may thus be prevented for erroneously or unintentionally adding the incorrect additive to body opening 218 and/or secondary opening 220.

As shown, a pin 234 may extend from door 230 along a pin axis 236. Pin 234 is fixed relative to door 230. Optionally, pin 234 may be an integral or unitary extension of door 230. Alternatively, pin 234 may be a discrete member fixed to a bottom portion of door 230 by an adhesive or mechanical connector (e.g., a threaded male-female interface). When assembled, pin axis 236 may define an axis of rotation for pin 234 and door 230. Movement of the pin 234 may thus correspond to movement of the door 230. As pin 234 rotates or slides, door 230 may also rotate or slide in kind.

In some embodiments, pin 234 is mounted directly to receptacle body 212. For instance, receptacle body 212 may define a mounting channel 238 that receives pin 234. Pin 234 may thus extend through mounting channel 238. Specifically, pin 234 may be slidably and/or rotatably positioned within mounting channel 238. In other words, pin 234 may be configured for axial and/or rotational movement relative to receptacle body 212. When mounted to receptacle body 212, pin 234 may be permitted to move along pin axis 236 (e.g., slide longitudinally along pin axis 236) within mounting channel 238. Additionally or alternatively, pin 234 may be permitted to rotate or pivot about pin axis 236.

In some embodiments, receptacle body 212 includes a pin sleeve 240 extending along mounting channel 238. Pin sleeve 240 may define at least a portion of mounting channel 238. When assembled, pin sleeve 240 extends about a portion of pin 234, e.g., to direct positioning of pin 234 within mounting channel 238. Optionally, pin sleeve 240 may define a dowel groove 244 that extends radially through pin sleeve 240 (e.g., in a radial direction R relative to pin axis 236). Moreover, a dowel 242 may extend in the radial direction from pin 234 and into pin sleeve 240. Thus, dowel groove 244 may generally direct movement of pin 234 and thereby movement of door 230.

In certain embodiments, dowel groove 244 defines a set movement path for dowel 242. The movement path of dowel groove 244 may include an axial component 246 and a circumferential component 248. Axial component 246 generally extends along pin axis 236. Circumferential component 248 generally extends along a circumferential direction C defined about pin axis 236. As shown, in some embodiments, axial component 246 and circumferential component 248 are discrete segments of movement path. Alternatively, axial component 246 and circumferential component 248 may be integrated, such that dowel groove 244 simultaneously extends along and about pin axis 236 (e.g., in a helical groove pattern).

In certain embodiments, fluid additive receptacle 210 includes a magnetic alignment pair 250. Included in the magnetic alignment pair 250 is a first magnetic element 252 and a second magnetic element 254. At least one of the first or second magnetic elements 252, 254 is a permanent magnet. The other of the first or second magnetic elements 252, 254 is a magnetically-matched material, such as a ferromagnetic material or another permanent magnetic. In turn, if first magnetic element 252 is a permanent magnet, second magnetic element 254 may be formed from a ferromagnetic material and/or a second magnet. Similarly, if second magnetic element 254, first magnetic element 252 may be formed from a ferromagnetic material and/or a second magnet. When assembled, magnetic alignment pair 250 may bias door 230 toward receptacle body 212. In other words, magnetic alignment pair 250 may bias door 230 toward the covered position or to remain in the covered position.

In some example embodiments, such as those shown in FIGS. 3 through 7, a first magnetic element 252 is positioned at a perimeter edge of door 230, e.g., at contoured edge 232. A second magnetic element 254 is positioned at a perimeter portion of body opening 218, e.g., at sloped perimeter 226. In the aforementioned example embodiments, first magnetic element 252 is a ferromagnetic rod embedded within door 230 at contoured edge 232. Second magnetic element 254 is a permanent magnet received within a corresponding recessed cavity 256 defined by receptacle body 212 at sloped perimeter 226.

Figure 8:
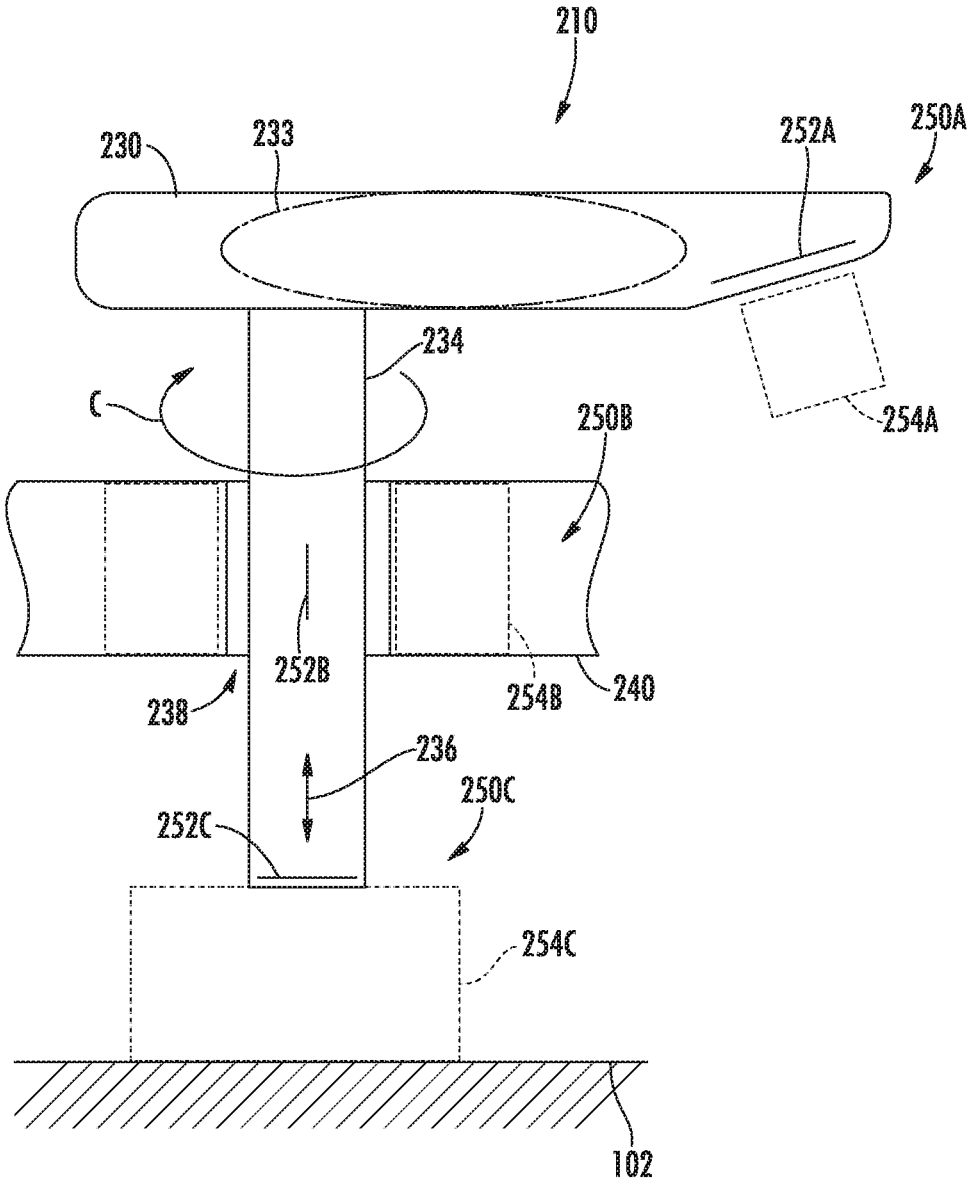
FIG. 8 provides a schematic side view of a fluid additive receptacle according to example embodiments of the present disclosure.
Figure 9:
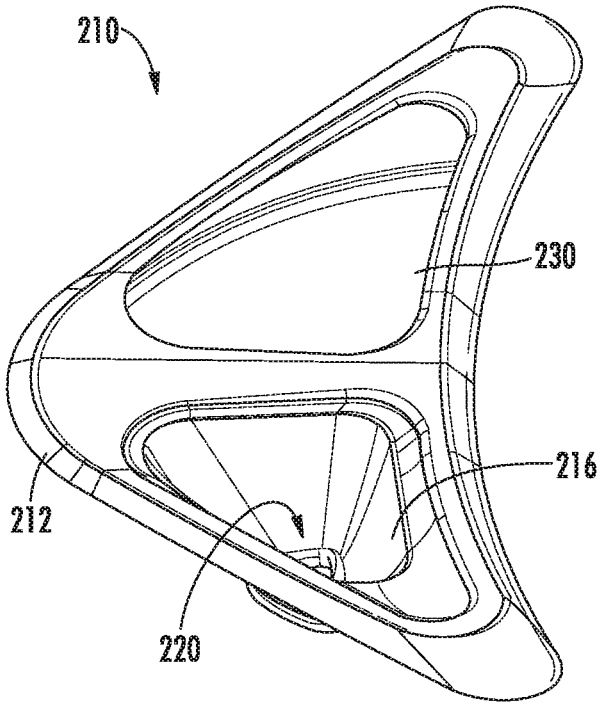
FIG. 9 provides a perspective view of a fluid additive receptacle according to example embodiments of the present disclosure, wherein the door is in a covered position.
Figure 10:
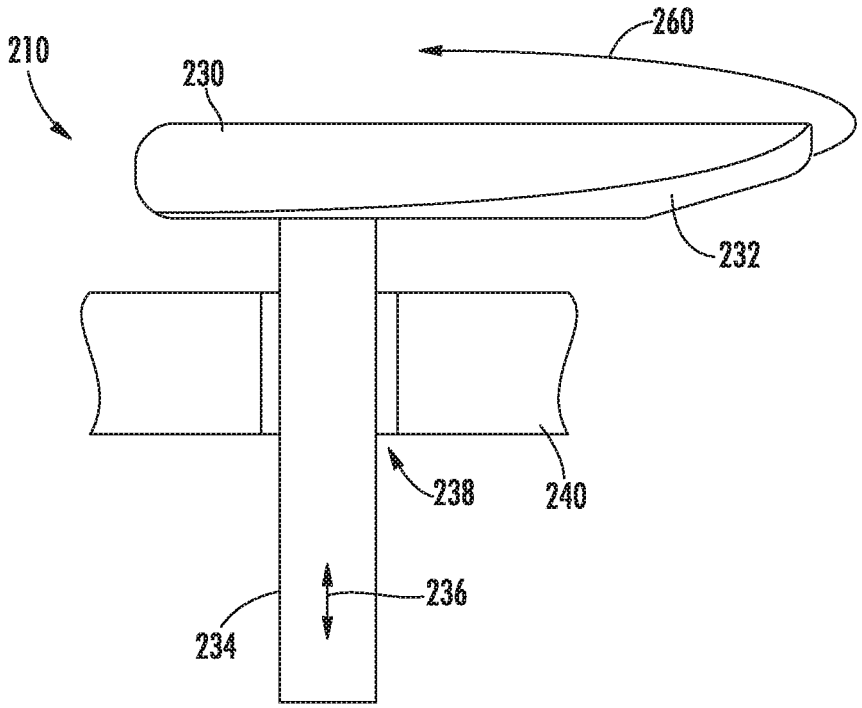
FIG. 10 provides a schematic side view of the example fluid additive receptacle of FIG. 9.
Figure 11:
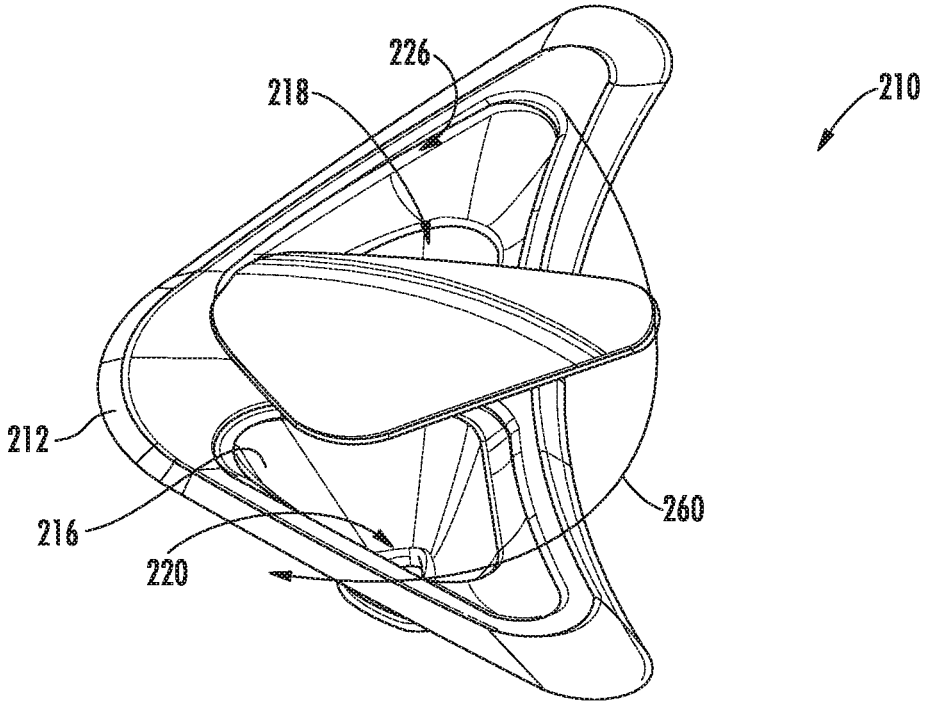
FIG. 11 provides a perspective view of the example fluid additive receptacle of FIG. 9, wherein the door is between a covered position and an uncovered position.
Figure 12:
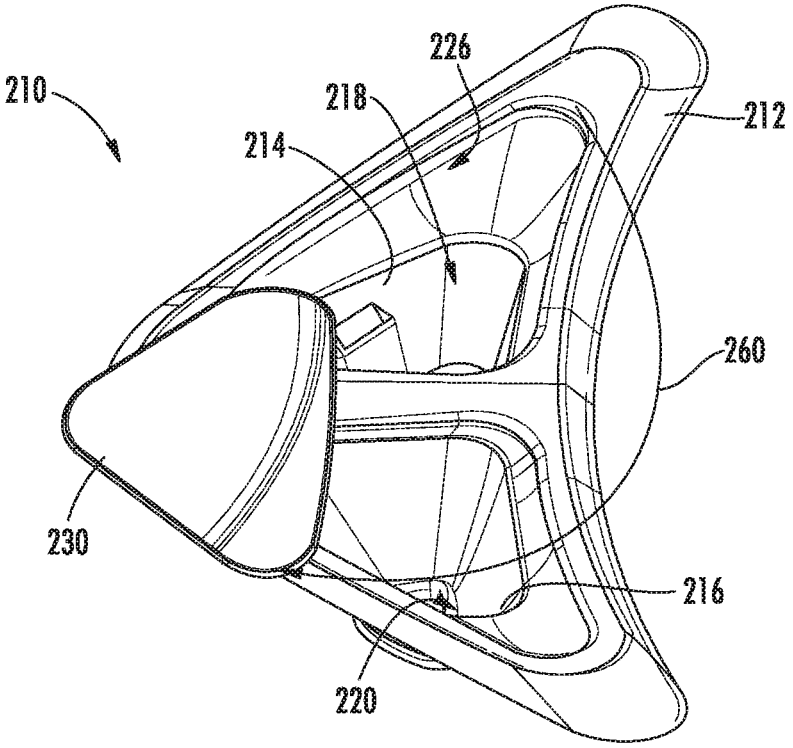
FIG. 12 provides a perspective view of the example fluid additive receptacle of FIG. 9, wherein the door is in an uncovered position.

Turning now to FIG. 8, a schematic side view of example embodiments of a fluid additive receptacle 210 that provides for additional or alternative configurations of magnetic alignment pair(s) 250. For instance, as described above, a magnetic alignment pair 250A may include a first magnetic element 252A positioned at a perimeter edge of door 230, as well as a second magnetic element 254A positioned at a perimeter portion of body opening 218 (see FIG. 6). In additional or alternative embodiments, a magnetic alignment pair 250B includes a first magnetic element 252B disposed within pin 234, as well as a second magnetic element 254B mounted about mounting channel 238. In still further additional or alternative embodiments, a magnetic alignment pair 250C includes a first magnetic element 252C disposed within pin 234, as well as a second magnetic element 254C mounted to washing machine appliance 100 below pin 234, e.g., on cabinet 102.

FIGS. 9 through 13 provide multiple views of another example fluid additive receptacle 210. It is noted that the illustrated embodiments of FIGS. 9 through 13 are understood to include some or all of the features of the embodiments of FIGS. 3 through 8, except as otherwise indicated.

Figure 13:
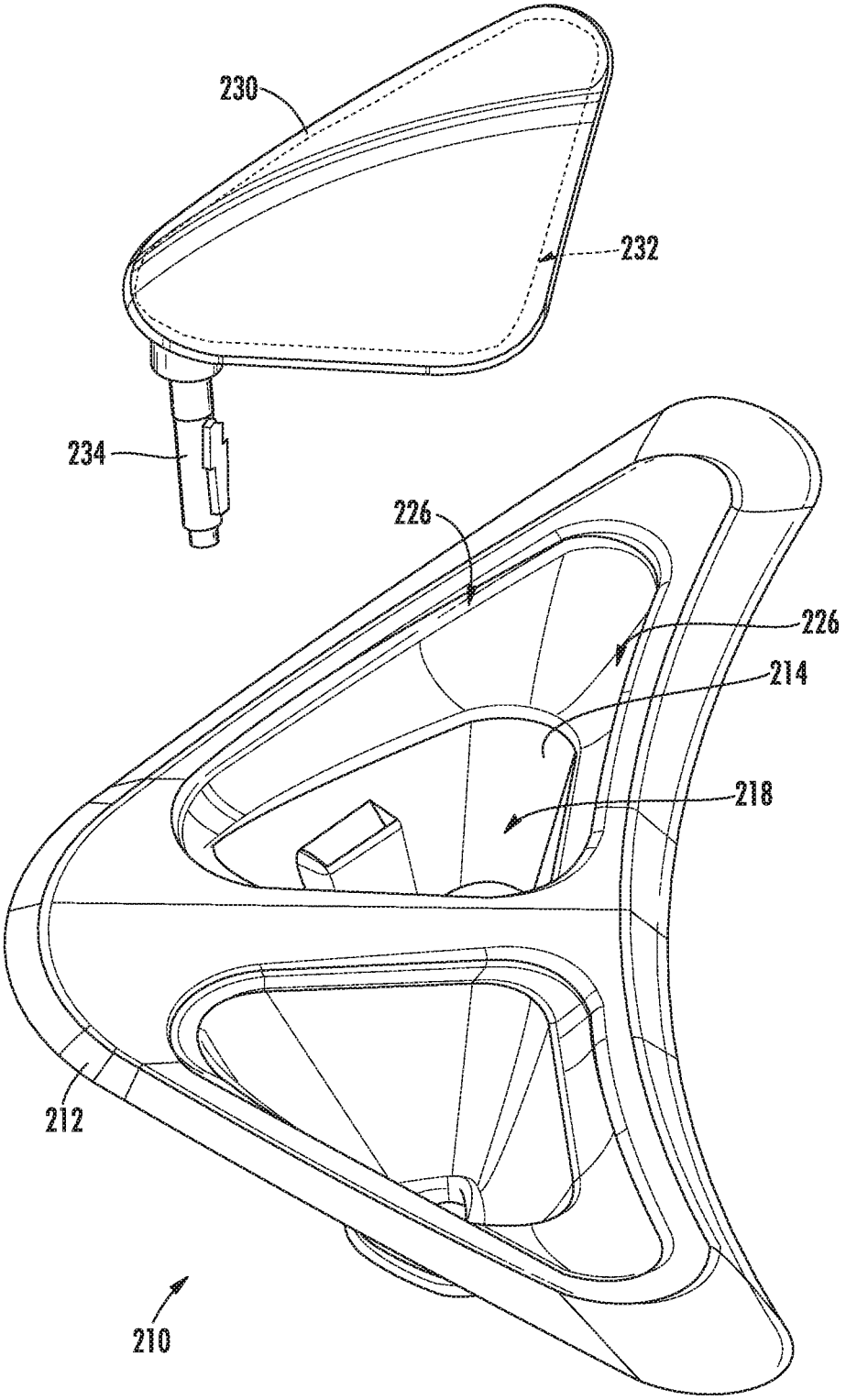
FIG. 13 provides an exploded perspective view of the example fluid additive receptacle of FIG. 9.

As shown in FIGS. 9 through 13, a pin 234 may be mounted within mounting channel 238 to freely rotate and slide axially. As described above, door 230 may rotate between a covered position (FIG. 9) and an uncovered position (FIG. 13). As door 230 rotates, e.g., as motivated by a user, door 230 may move along a helical path 260. The helical path 260 may be generally defined by a contoured edge 232 of door 230. Contoured edge 232 is formed along a smooth angled pattern. As door 230 is pushed, e.g., clockwise, contoured edge 232 will engage the sloped perimeter 226 of receptacle body 212. As the angled countered edge engages receptacle body 212, it may also slide along sloped perimeter 226, e.g., about body opening 218. Moreover, this engagement between the angled contoured edge 232 and the sloped perimeter 226 may push the door 230 upward and cause the door 230 to rise, e.g., axially above body opening 218, in synchronization with the rotational movement. Conversely, the door 230 may close, e.g., as motivated by gravity, along helical path 260 in the reverse direction.

Optionally, pin 234 and mounting channel 238 may define a mated circular cross-sectional profile. Thus, the path of movement for the door 230 relative to receptacle body 212 may be defined exclusively by the engagement between door 230 and receptacle body 212. In additional or alternative embodiments, fluid additive receptacle 210 may be free of any magnetic assembly. For instance, alignment between door 230 and receptacle body 212 may be directed by gravity and the constrained movement of the angled contoured edge 232 against and along sloped perimeter 226.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet having a top cover, the top cover of the cabinet defining an opening;

a tub disposed within the cabinet below the top cover;

a basket rotatably mounted within the tub; and a fluid additive receptacle comprising a receptacle body defining a body opening to receive an additive therethrough, the receptacle body further defining a mounting channel, a door removably mated to the receptacle body to selectively cover the body opening, a pin extending along a pin axis from the door to the receptacle body, the pin being slidably positioned within the mounting channel and pivotable about the pin axis, and a magnetic alignment pair biasing the door toward the receptacle body, the magnetic alignment pair comprising a first magnetic element and a second magnetic element, wherein the first magnetic element is disposed within the pin, and wherein the second magnetic element is mounted about the mounting channel.

2. The washing machine appliance of claim 1, wherein the door is rotatable between a covered position restricting access to the body opening and an uncovered position permitting access to the body opening, wherein the door defines a contoured edge engaged with the receptacle body to direct the door between the uncovered position and the covered position.

3. The washing machine appliance of claim 2, wherein the contoured edge defines a helical rotation path for the door between the covered position to the uncovered position.

4. The washing machine appliance of claim 1, wherein the receptacle body defines a secondary opening spaced apart from the body opening and the door.

5. The washing machine appliance of claim 1, wherein the pin includes a dowel extending in a radial direction from the pin axis, and the receptacle body includes a pin sleeve extending about the pin and defining a dowel channel to receive the dowel and direct movement of the door.

6. The washing machine appliance of claim 5, wherein the dowel channel includes an axial component and a circumferential component.

7. A washing machine appliance, comprising:

a cabinet having a top cover, the top cover of the cabinet defining an opening;

a tub disposed within the cabinet below the top cover;

a basket rotatably mounted within the tub; and a fluid additive receptacle comprising a receptacle body defining a body opening to receive an additive therethrough, the receptacle body further defining a mounting channel, a door removably mated to the receptacle body to selectively cover the body opening, a pin extending along a pin axis from the door to the receptacle body, the pin being slidably positioned within the mounting channel and pivotable about the pin axis, and a magnetic alignment pair biasing the door toward the receptacle body, the magnetic alignment pair comprising a first magnetic element and a second magnetic element, wherein the first magnetic element is disposed within the pin, and wherein the second magnetic element is mounted to the washing machine appliance below the pin.

8. The washing machine appliance of claim 7, wherein the door is rotatable between a covered position restricting access to the body opening and an uncovered position permitting access to the body opening, wherein the door defines a contoured edge engaged with the receptacle body to direct the door between the uncovered position and the covered position.

9. The washing machine appliance of claim 8, wherein the contoured edge defines a helical rotation path for the door between the covered position to the uncovered position.

10. The washing machine appliance of claim 7, wherein the receptacle body defines a secondary opening spaced apart from the body opening and the door.

11. The washing machine appliance of claim 7, wherein the pin includes a dowel extending in a radial direction from the pin axis, and receptacle body includes a pin sleeve extending about the pin and defining a dowel channel to receive the dowel and direct movement of the door.

12. The washing machine appliance of claim 11, wherein the dowel channel includes an axial component and a circumferential component.

13. A washing machine appliance, comprising:

a cabinet having a top cover, the top cover of the cabinet defining an opening;

a tub disposed within the cabinet below the top cover;

a basket rotatably mounted within the tub; and a fluid additive receptacle comprising a receptacle body defining a body opening to receive an additive therethrough, the receptacle body further defining a mounting channel, a door removably mated to the receptacle body to selectively cover the body opening, a pin extending along a pin axis from the door to the receptacle body, the pin being slidably positioned within the mounting channel and pivotable about the pin axis, and a magnetic alignment pair biasing the door toward the receptacle body; the magnetic alignment pair comprising a first magnetic element and a second magnetic element, wherein the pin includes a dowel extending in a radial direction from the pin axis, and the receptacle body includes a pin sleeve extending about the pin and defining a dowel channel to receive the dowel and direct movement of the door.

14. The washing machine appliance of claim 13, wherein the door is rotatable between a covered position restricting access to the body opening and an uncovered position permitting access to the body opening, wherein the door defines a contoured edge engaged with the receptacle body to direct the door between the uncovered position and the covered position.

15. The washing machine appliance of claim 14, wherein the contoured edge defines a helical rotation path for the door between the covered position to the uncovered position.

16. The washing machine appliance of claim 13, wherein the receptacle body defines a secondary opening spaced apart from the body opening and the door.

17. The washing machine appliance of claim 13, wherein the first magnetic element is disposed within the door, and wherein the second magnetic element is disposed within the receptacle body.

18. The washing machine appliance of claim 13, wherein the first magnetic element is positioned at a perimeter edge of the door, and wherein the second magnetic element is positioned at a perimeter portion of the body opening.

* * * * *